US005181311A

United States Patent [19]

Lee

[11] Patent Number: 5,181,311

[45] Date of Patent: Jan. 26, 1993

[54] METHOD FOR MANUFACTURING AN AMORPHOUS METAL CORE FOR A TRANSFORMER THAT INCLUDES STEPS FOR REDUCING CORE LOSS

[75] Inventor: Albert C. Lee, Hickory, N.C.

[73] Assignee: General Electric Company, Hickory, N.C.

[21] Appl. No.: 773,405

[22] Filed: Oct. 9, 1991

[51] Int. Cl.[5] ..... H01F 3/04; H01F 41/02

[52] U.S. Cl. ..... 29/609; 336/234

[58] Field of Search ..... 29/609, 605; 336/205, 336/206, 213, 234; 72/146-148

[56] References Cited

U.S. PATENT DOCUMENTS 4,413,406 11/1983 Bennett et al. ..... 29/609

4,467,632 8/1984 Klappert ..... 72/147

*Primary Examiner*—Carl E. Hall

*Attorney, Agent, or Firm*—Henry J. Policinski; William Freedman

[57] ABSTRACT

This method for making a transformer core comprises the following steps: (a) providing amorphous metal strip material, (b) winding said strip material onto an arbor in superposed layers, thereby forming a multi-layered core form, (c) applying coats of powder to said strip material before the strip material is wound onto the arbor, thereby causing predetermined adjacent ones of said layers by to be separated small distances to reduce the space factor of the core form, and (d) annealing the core form while said powder coatings are present between adjacent layers, thus enabling the powder to lessen the tendency of adhesions to develop between adjacent layers of amorphous metal during annealing.

8 Claims, 2 Drawing Sheets

METHOD FOR MANUFACTURING AN AMORPHOUS METAL CORE FOR A TRANSFORMER THAT INCLUDES STEPS FOR REDUCING CORE LOSS

FIELD OF INVENTION

This invention relates to a method for manufacturing a transformer core that comprises amorphous metal strip material wrapped about the window of the core and, more particularly, relates to a method of this type that includes steps for reducing the core loss developed within the transformer when energized.

BACKGROUND

In the general type of core-manufacturing method that we are concerned with, magnetic strip material is wrapped in superposed relationship about the window of the core to build up a core form, and the core form is later annealed at elevated temperature to relieve stresses therein. A problem that arises in such manufacture is that the pressure of the wrapping and other pre-annealing operations and the heat of the annealing operation often produce, within the core, regions where juxtaposed layers of strip material adhere together and form relatively low resistance paths, or shorts, between the adhering strip layers. Such internal adhesions or shorts are undesirable because they can produce within the core, transversely of the flux path therethrough, low resistance closed circuits for eddy currents; and such closed circuits have the detrimental effect of reducing the effective net cross-section of the core, the amount of such reduction being a direct function of the cross-sectional area bounded by such closed circuit or circuits.

Application Ser. No. 07/726,239—Lee et al, filed Jul. 5, 1991, issued as U.S. Pat. No. 5,134,771, assigned to the assignee of the present invention, and incorporated by reference herein, discloses several different methods for reducing the number of such internal shorts that are present in the final core. These methods all involve breaking up the internal shorts after they have formed during annealing.

OBJECTS

An object of the present invention is to make an amorphous metal core by a method that reduces the tendency of the internal shorts to form, thus reducing the need for subsequent steps to break up such shorts.

Another object is to reduce eddy current loss in the amorphous metal core by reducing the space factor of the core.

One procedure that has the effect of reducing the space factor of the core is providing the amorphous metal strip material that is used for making the core with a bonded coating of electrical insulating material. Such coatings are often used in the manufacture of traditional strip material, e.g., silicon steel strip material, that is used for transformer core manufacture. But when this technique has been attempted for amorphous metal strip material, it has not produced the desired reduction in eddy current loss. Amorphous metal is very sensitive to mechanical stresses; and the bonded coating produces mechanical stresses in the amorphous strip material, especially during wrapping, shaping, and annealing, which increase the core loss by an amount greater than the reductions otherwise attributable to the bonded coating.

Another object of my invention is to provide a coating for the amorphous strip material that reduces the core space factor but does not introduce mechanical stresses that nullify the benefits of the coating in reducing eddy current loss.

SUMMARY

In carrying out the invention in one form, I provide amorphous metal strip material, and I wrap said strip material onto an arbor in superposed layers, thereby forming a multi-layered core form. I apply one or more coats of powder to said strip material before the strip material is wrapped onto the arbor, thereby separating predetermined adjacent ones of said layers by small distances to control the space factor of the core form. The core form is annealed while said one or more powder coats are present between adjacent layers, thus enabling said powder to lessen the tendency of adhesions to develop between adjacent layers of amorphous metal during annealing.

BRIEF DESCRIPTION OF FIGURES

For a better understanding of the invention, reference may be had to the following detailed description taken in connection with the accompanying drawings, wherein.

DETAILED DESCRIPTION OF EMBODIMENTS

Figure 1:
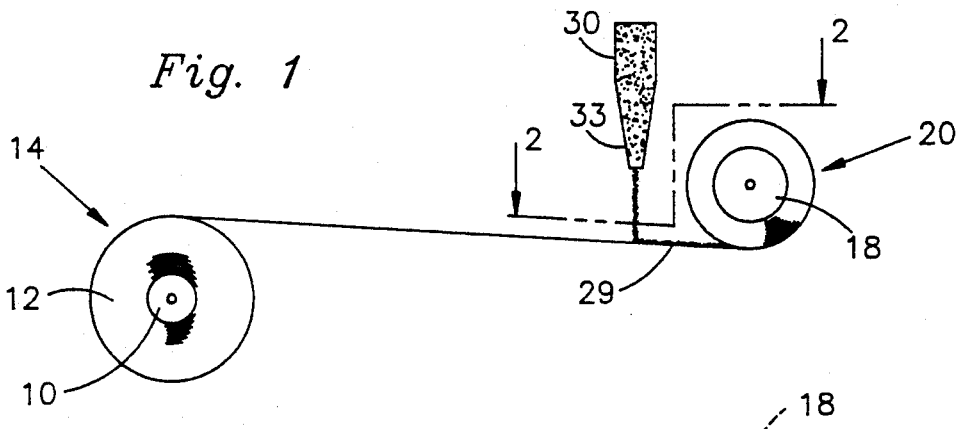
FIG. 1 is schematic side-elevational view showing certain steps used in a method of transformer-core manufacture embodying one form of our invention.

Referring now to FIG. 1, there is shown a pay-out reel 10 on which amorphous metal strip material 12 has been wound to form a spool 14 of amorphous metal strip material. Preferably, the strip material has been wound on the reel in multiple-layer thickness, as in Application Ser. No. 622,364 Ballard & Klappert, filed Dec. 5, 1990, issued as U.S. Pat. No. 5,050,294, and assigned to the assignee of the present invention.

Figure 3:
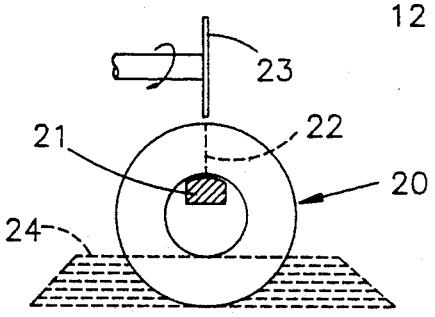
FIG. 3 is a side elevational view showing another step used in a method embodying one form of our invention.
Figure 5:
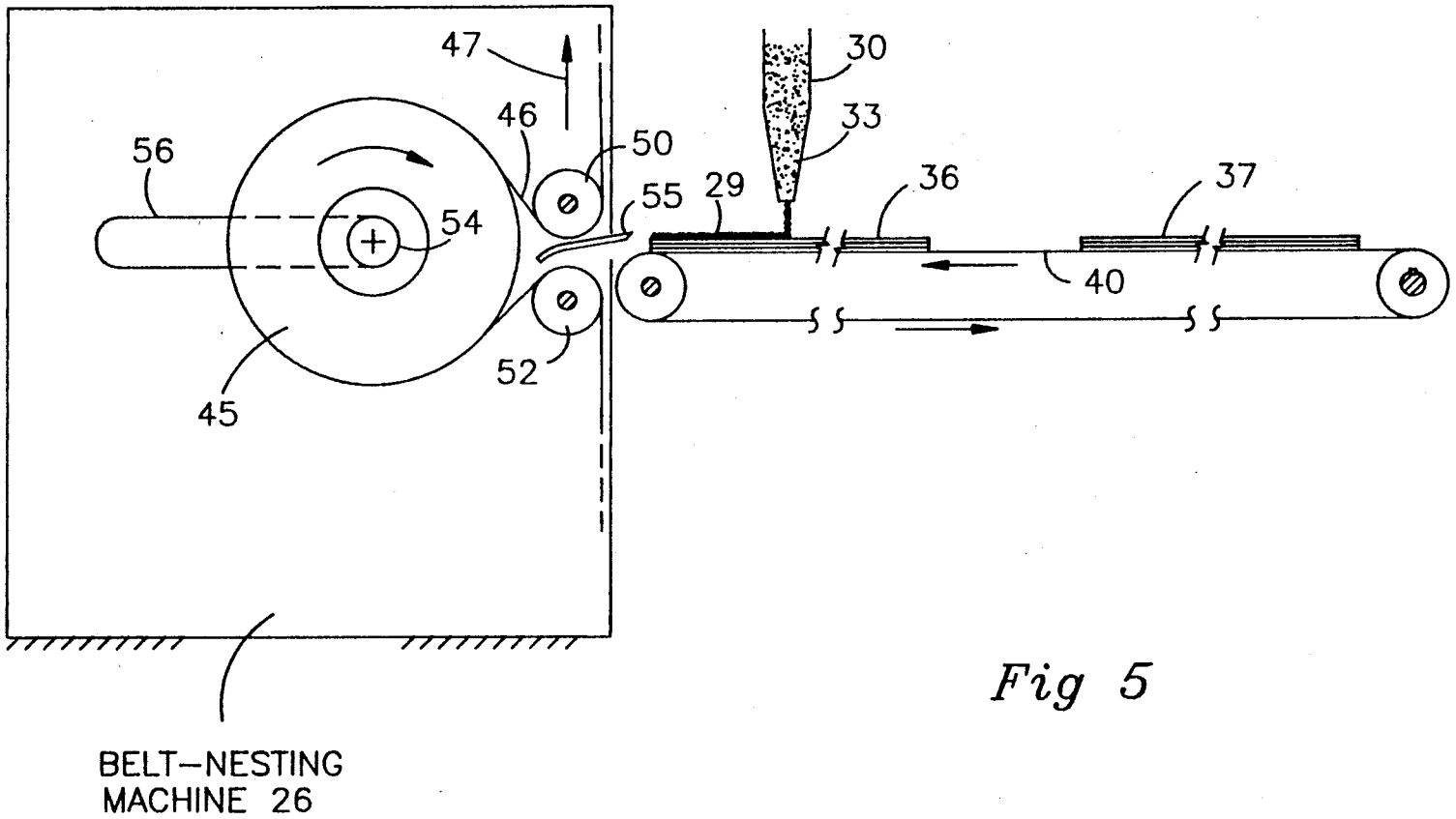
FIG. 5 shows a modified form of our invention.

As shown in FIG. 1, the strip material 12 is unwound from spool 14, and as it is thus unwound, is wound about a rotatable mandrel 18 to form a toroid 20. When a predetermined build has been achieved in the toroid 20, this winding operation is discontinued and the strip material is cut off near the toroid. The toroid is then removed from mandrel 18 and placed upon a support 21, as shown in FIG. 3. As further illustrated in FIG. 3, the toroid 20 is then cut through radially along a line 22, using a thin rotating abrasive wheel 23, As the turns of the toroid 20 are severed, they expand into a flattened condition and fall into a stack 24 of amorphous metal strips in essentially the same manner as described in U.S. Pat. No. 4,734,975—Ballard et al. Thereafter, groups of these strips are taken from the stack 24 and are fed into a belt-nesting machine 26 of conventional form (shown schematically in FIG. 5), which produces another toroid that has an appropriately configured joint where the ends of the groups meet. This joint can be either a lap-type joint or a butt-type joint, depending upon the manufacturer's preference. A belt-nesting machine of the general type that we prefer to use is disclosed and claimed in Application Ser. No. 623,265—Klappert and Houser, filed Dec. 6, 1990, assigned to the assignee of the present invention and incorporated by reference in the present application. Some features of this machine are generally illustrated in FIG. 5. For example, a rotatable arbor 45 having a horizontal axis is encircled by a flexible belt 46, and groups of strips are guided into the space between the belt and arbor, where they are wrapped about the arbor as the belt moves in the direction of arrow 47 to rotate the arbor in a clockwise direction. Where the groups of strips enter the space between the belt and the arbor, there are two vertically-spaced front rollers 50 and 52 about which the belt 46 is partially wrapped. A thin guide 55 directs the groups generally downward as they enter the gap between the rollers. The rollers 50 and 52 serve as guide rollers for the belt 46 and are rotatable mounted on fixed axes. As shown in the aforesaid Klappert and Houser application 623,265, the belt 46 is an endless flexible belt that extends externally of the arbor 45 and guide rollers 50 and 52 around a series of additional guide rollers, tensioning rollers, and a motor-driven pulley (none of which are shown in the present application) to enable the belt to be appropriately driven as shown. The arbor 45 is supported on a shaft 54 which is slidably mounted in slots 56 in a stationary support 58. As the core form is built up about the arbor, the shaft 54 is forced to shift to the left in the slots 56 against the opposing bias of the belt-tensioning device (not shown), thus providing room for new groups of strips fed onto the arbor.

Each group of strips typically comprises a large number of strips (e.g., about 30) disposed in superposed substantially aligned relationship. These groups can be fed individually into the belt-nesting machine; or packets consisting of a plurality of these groups disposed in longitudinally-staggered relationship can be fed into the belt-nesting machine 26. The Klappert and Houser application illustrates such packets and how individual packets are fed into the belt-nesting machine and wrapped one at a time about the arbor.

Figure 4:
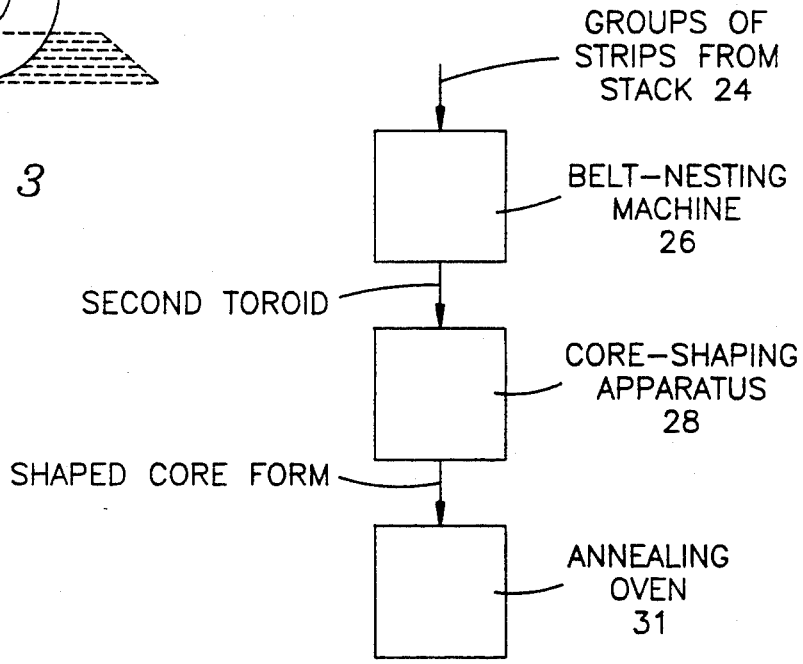
FIG. 4 is a diagrammatic view showing additional steps used in practicing our invention in one form.

After a toroid of the desired build has been formed in the belt nesting machine, this toroid is removed from the arbor of the belt nesting machine and is suitably shaped in a conventional manner, as by core-shaping apparatus 28 in which appropriately configured tools are inserted into the core window and are then forced apart. Thereafter, the shaped core form is placed in an annealing oven 31, where it is heated and then slowly cooled to relieve stresses in the amorphous metal strip material. These nesting, shaping, and annealing steps are all conventional and are illustrated only diagrammatically in the drawings. See the flow diagram of FIG. 4.

Figure 2:
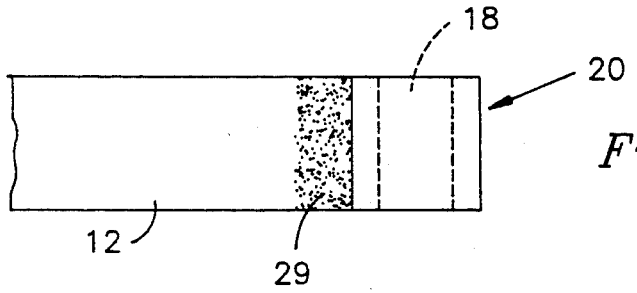
FIG. 2 is a plan view taken along the line 2—2 of FIG. 1.

As pointed out in the introductory portion of this application, there is a tendency for adjacent amorphous metal strips in the core to adhere together in localized regions during the annealing operation, thereby forming undesirable internal adhesions or shorts within the core. We reduce the tendency for such internal adhesions to form by depositing on the amorphous strip material a coat of powder of electrical insulating material. In one embodiment, shown in FIGS. 1 and 2, this coat of powder (schematically shown at 29) is deposited just prior to the strip material's entry into the first toroid 20. More specifically, as shown in FIG. 1, a force-feed powder dispenser 30 is located just above the strip material in a location near the toroid 20. This dispenser has a downwardly-directed output nozzle 33 having a width that extends across the entire width of the strip material. A moderate pressure is maintained above the powder in the dispenser, and this pressure, assisted by gravity, forces powder through the nozzle 33 onto the upper surface of the strip material. Because the upper surface of the strip material, upon entering the toroid 20, faces a previously-wound turn of the toroid, the powder thereon is held captive between adjacent turns of the toroid as the toroid is rotated during the toroid-forming, or winding, step.

The deposited powder controls the space factor of the toroid 20, maintaining predetermined adjacent turns of the toroid separated by small distances. When the toroid 20 is cut, as shown in FIG. 3, most of the powder remains in place between adjacent turns and does not interfere with formation of the stack 24. When groups are taken from the stack, most of the powder remains in place within or on the groups and is incorporated in the second toroid, which is formed in the belt-nesting machine 26.

The groups of strips are fed into the belt-nesting machine 26 so that the upper surface of each group faces a previously-wound turn, and this reduces the tendency for the powder to fall off the toroid as the toroid is rotated during the belt-nesting operation.

In another embodiment of the invention, the powder deposition step is omitted from the toroid-winding operation of FIG. 1 and is carried out after the stack 24 of FIG. 3 has been formed. As shown in FIG. 5, groups such as 36 and 37 that are taken from the stack 24 are fed by a conveyor belt 40 into the belt-nesting machine 26, and the powder dispenser 30 is located just ahead of the belt-nesting machine. The powder dispenser deposits powder upon the upper surface of the groups as each is fed by the belt 40 into the belt-nesting machine. The toroid formed by the belt-nesting machine has coats of powder deposited between predetermined layers of amorphous metal strip. To help retain the powder in place during belt-nesting, the belt-nesting machine is operated in such a direction (with arbor 45 rotating clockwise as viewed in FIG. 5) that the powder-coated surface of the entering group or groups faces a previously wound turn.

Most of the powder remains in place during the subsequent core-shaping operation and the annealing operation and thus is effective to maintain a small amount of separation between predetermined turns of the core and thereby to reduce the tendency of internal adhesions to form during the annealing operation.

If the strips are fed into the belt nesting machine in packets (each packet comprising a plurality of groups stacked in longitudinally-staggered relationship), then the powder dispenser of FIG. 5 will apply a powder coating to the top of each packet. In addition, since the forward end of each group in the packet is exposed as a result of the staggered relationship of the groups, these ends of the groups are also coated by powder from the dispenser 30.

In each of the above embodiments, powder from the dispenser 30 may be applied to substantially the entire upper surface of amorphous strip material passing beneath the dispenser, or the powder may be applied intermittently and in such a manner that the deposited powder appears as a series of spaced-apart coatings on the upper surface of the strip material, thereby resulting in circumferentially spaced-apart coatings on individual turns of the core form. The latter procedure will maintain sufficient spacing between adjacent turns for certain applications, but the substantially-continuous coating approach provides greater assurance that the desired spacing between adjacent turns will be maintained about the entire periphery of the adjacent turns.

In addition to reducing the tendency of internal adhesions to form, the presence of the powder coating serves another desirable purpose. More specifically, it reduces eddy current loss in the final core by reducing the space factor of the core due to the small separation between adjacent turns that it introduces. Eddy current loss varies as a direct function of space factor, and the reduced space factor thus has the effect of reducing eddy current loss. While others in this field have proposed to apply a bonded coating to the amorphous strip material, similar in character to that commonly applied to traditional silicon-steel strip material used in transformer manufacture, this technique has not been very effective in reducing core loss when applied to amorphous metal strip material. Such a bonded coating subjects the amorphous strip material to stresses, especially as a result of wrapping, core-shaping, and then annealing. Because amorphous metal is very sensitive to mechanical stresses, the beneficial effects of reduced space factor in terms of core loss are largely nullified by the adverse results of the higher stresses.

My procedure creates much lower mechanical stresses than the bonded coating because the powder is not significantly bonded to the underlying amorphous metal strip, thus allowing the amorphous strip material, during processing, to expand and contract much more freely than does the bonded coating. With respect to this absence of significant bonding, my annealing operation raises the temperature of the strip material to only about 350 C. maximum, and this is not high enough to create any significant bond between the powdered coating and the underlying amorphous metal strip.

Although I have illustrated and described hereinabove one specific procedure (i.e., winding and then cutting the toroid 20) for producing the multi-layer groups of amorphous metal strip that are fed into the belt-nesting machine 26, it is to be understood that my invention in its broader aspects comprehends the use of other procedures for producing these groups. One such procedure is disclosed in the aforesaid application Ser. No. 623,265—Klapperty and Houser. There, a composite amorphous metal strip is cut into sections of controlled length, and single ones of these sections (or a plurality stacked together) constitute groups which are fed into the belt-nesting machine. The above-described composite strip is made up by first employing a prespooling operation, in which single-layer thickness strip is unwound from a plurality of reels and is then combined into multipler-layer thickness strip, which is then wound on a plurality of master reels. Then multiple-layer thickness strip is unwound from the master reels and combined into the above-described composite strip. In applying my method to the above-described procedure of the Klappert and Houser application, I can apply powder to the strip material at any point prior to its entry into the belt-nesting machine. For example, in one embodiment, I apply the powder to the sections of controlled length that are cut from the composite strip. In another embodiment, I apply the powder to the single-layer thickness strip before it is combined into the multiple-layer thickness strip. And in still another embodiment, I apply the powder to the multiple-layer thickness strip that is combined to form the composite strip. In general, the more layers of strip that receive the powder coating, the fewer will be the internal adhesions and the lower will be the space factor in the final core, both of which contribute to reduced core loss.

A type of powder that I have found adheres well to the amorphous metal strip is finely-ground magnesium metasilicate, $H_2Mg_3(SiO_3)_4$, or talc. While adhering mechanically, but not significantly bonding, to the underlying amorphous metal, a thin coating of such material applied as described above has no significant mechanical strength that would enable it to resist expansion and contraction of the amorphous metal. Accordingly, the presence of such coating does not result in appreciable mechanical stresses being introduced into the amorphous metal during processing. This is in distinct contrast to the behavior of a bonded coating, e.g., like that used in the production of traditional silicon-steel strip for transformer core manufacture. Attempts to use this latter type of coating on amorphous metal strip have resulted in mechanical stresses in the amorphous metal that, in terms of core loss, have largely nullified the benefits derived from the presence of such a coating.

While I have shown and described particular embodiments of my invention, it will be obvious to those skilled in the art that various changes and modifications may be made without departing from the invention in its broader aspects; and I, therefore, intend herein to cover all such changes and modifications as fall within the true spirit and scope of the invention.

What I claim as new and desire to secure by Letters Patent of the United States is:

1. A method of making a transformer core from amorphous metal strip material wrapped about the window of the core, comprising the following steps:

(a) providing amorphous metal strip material having essentially no insulating coating applied and bonded thereto, (b) wrapping said strip material onto an arbor in superposed layers, thereby forming a multi-layered core form, (c) applying one or more coats of powder to said strip material before the strip material is wrapped onto the arbor, thereby causing predetermined adjacent ones of said layers to be separated by small distances to control the space factor of said core form, (d) annealing said core form while said one or more powder coats are present between adjacent layers, thus enabling said powder to lessen the tendency of adhesions to develop between adjacent layers of amorphous metal during annealing, and (e) maintaining said powder coatings substantially unbonded with respect to the underlying amorphous metal strip material during annealing.

2. The method of claim 1 in which said wrapping step is effected by winding said strip material onto said arbor in such a direction that the powder-coated surface on the strip material, upon entering said core form, faces a previously-wound turn of said core form.

3. The method of claim 1 in which:

(a) said arbor is a component of a belt-nesting machine and has a generally horizontal axis, and (b) said wrapping step is effected by said belt-nesting machine's winding said strip material onto said arbor in such a direction that the powder-coated surface on the strip material, upon entering said core form, faces a previously-wound turn of said core form.

4. The method of claim 1 in which:

(a) said arbor is a component of a belt-nesting machine, (b) said wrapping step is effected by winding onto said arbor groups of strips fed into said belt-nesting machine, each group comprising superposed substantially aligned strips, and (c) said powder is applied to said groups of strips on surfaces that cause the powder coatings to be located between layers of the multi-layered core form.

5. The method claim 1 in which said wrapping step is effected by winding said strip material onto said arbor.

6. The method of claim 1 in which said powder is applied to substantially each layer of strip material within said core form.

7. The method of claim 1 in which said powder is applied around generally the full periphery of those turns of the core form on which the powder is present.

8. The method of claim 1 in which said powder is applied intermittently to the strip material and in such a manner that the deposited powder appears as a series of circumferentially spaced-apart coatings on individual turns of the core form.

* * * * *